US006603370B2

(12) United States Patent
Dejima

(10) Patent No.: US 6,603,370 B2
(45) Date of Patent: Aug. 5, 2003

(54) NONRECIPROCAL CIRCUIT DEVICE WITH A CASING AVERAGE SURFACE ROUGHNESS LESS THAN OR EQUAL TO 0.9 MICRONS

(75) Inventor: Hiroki Dejima, Kanazawa (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 10/033,773

(22) Filed: Dec. 28, 2001

(65) Prior Publication Data

US 2002/0084865 A1 Jul. 4, 2002

(30) Foreign Application Priority Data

Dec. 28, 2000 (JP) ..... 2000-401571

(51) Int. Cl.[7] ..... H01P 1/383; H01P 1/36
(52) U.S. Cl. ..... 333/1.1; 333/24.2
(58) Field of Search ..... 333/1.1, 24.2

(56) References Cited

U.S. PATENT DOCUMENTS 4,812,787 A * 3/1989 Kuramoto et al. ..... 333/1.1
6,060,958 A * 5/2000 Tokudera et al. ..... 333/1.1
6,087,905 A * 7/2000 Makino et al. ..... 333/1.1

* cited by examiner

*Primary Examiner*—Justin P. Bettendorf
(74) *Attorney, Agent, or Firm*—Ostrolenk, Faber, Gerb & Soffen, LLP

(57) ABSTRACT

An isolator serving as a nonreciprocal circuit device includes a permanent magnet, a ferrite to which a DC magnetic field is applied by the permanent magnet, a plurality of center electrodes placed on the ferrite, and upper and lower casings for accommodating the permanent magnet, the ferrite, and the center electrodes. The upper and lower casings are made of a material chiefly containing iron, and the average value of the surface roughness of the casings is less than or equal to 0.9 $\mu$m. The front and rear surfaces of the upper and lower casings are Ag-plated.

8 Claims, 4 Drawing Sheets

NONRECIPROCAL CIRCUIT DEVICE WITH A CASING AVERAGE SURFACE ROUGHNESS LESS THAN OR EQUAL TO 0.9 MICRONS

BACKGROUND OF THE INVENTION

1. Field of the Invention

The present invention relates to a nonreciprocal circuit device and a communication device.

2. Description of the Related Art

A general type of lumped-constant isolator (which is a type of nonreciprocal circuit device) adopted in mobile communication devices, such as portable telephones, serves to transmit signals only in a transmission direction and not in the opposite direction. In recent years, there has been an increasing demand for mobile communication devices with higher reliability and higher performance to satisfy an increasing range of uses. Consequently, there has been a need to improve the reliability and performance of the lumped-constant isolator.

Such a lumped-constant isolator comprises a permanent magnet, a ferrite to which a DC magnetic field is applied by the permanent magnet, a plurality of center electrodes placed on the ferrite, a resin casing for accommodating the ferrite and the center electrodes, upper and lower casings for accommodating the permanent magnet, the ferrite, and the center electrodes, and the like. The upper casing and the lower casing are joined so as to form a magnetic circuit and to also function as a yoke. The upper casing and the lower casing are usually made of a thin plate chiefly containing iron.

Hitherto, studies on the thickness and shape of the thin plate chiefly containing iron have been conducted in order to reduce the size of the isolator and to reduce the leakage of the DC magnetic field applied by the permanent magnet. Furthermore, there have been attempts to reduce the insertion loss of the isolator by plating the surface of the thin plate chiefly containing iron with a material having a low electrical resistance (for example, Ag).

However, no specific limitations have hitherto been placed on the surface roughness of the thin plate chiefly containing iron. This is because the surface roughness varies according to the type of working roll used to produce a rolled steel thin plate. For this reason, there are limitations to the degree to which the insertion loss of the isolator can be reduced.

SUMMARY OF THE INVENTION

The present invention provides a nonreciprocal circuit device and a communication device with high reliability and high performance and with reduced insertion loss.

According to an aspect of the present invention, there is provided a nonreciprocal circuit device including a permanent magnet, a ferrite to which a DC magnetic field is applied by the permanent magnet, a plurality of center electrodes placed on the ferrite, and a metal casing for accommodating the permanent magnet, the ferrite, and the center electrodes, wherein the metal casing is made of a material chiefly containing iron, and the average value of the surface roughness of the entirety of the metal casing is less than or equal to 0.9 $\mu$m.

Since the average value of the surface roughness of the metal casing is set to be less than or equal to 0.9 $\mu$m, the insertion loss of the nonreciprocal circuit device can be reduced, and the reliability and performance of the nonreciprocal circuit device can be improved.

According to another aspect of the present invention, there is provided a communication device having a nonreciprocal circuit device having the above features. This communication device can provide superior high-frequency characteristics.

Further, features and advantages of the present invention will become apparent from the following description of embodiments thereof, with reference to the attached drawings.

DESCRIPTION OF EMBODIMENTS OF THE INVENTION

A nonreciprocal circuit device and a communication device according to embodiments of the present invention will be described below with reference to the attached drawings.

Figure 1:
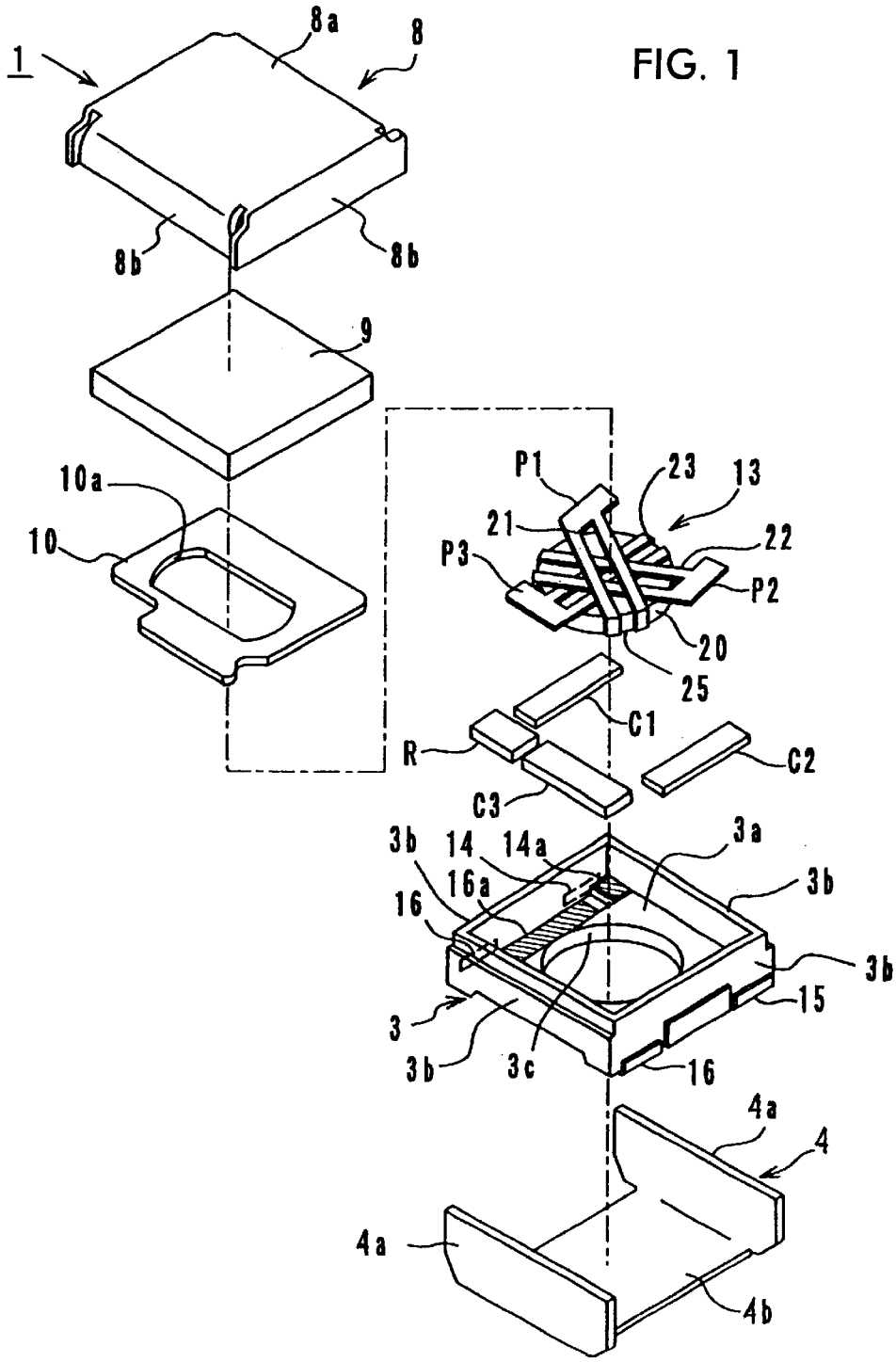
FIG. 1 is an exploded perspective view showing the configuration of a nonreciprocal circuit device according to a first embodiment of the present invention.
Figure 2:
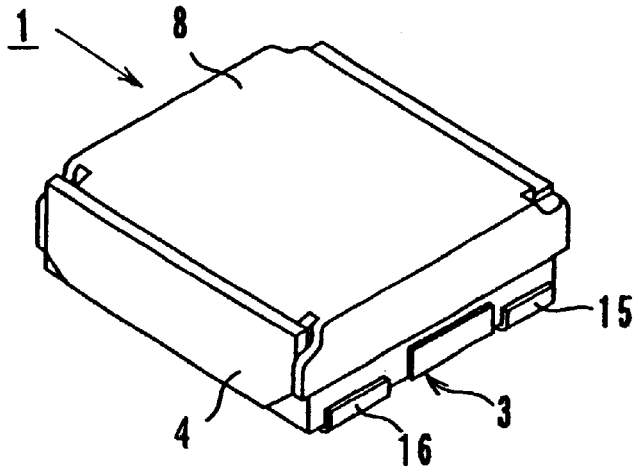
FIG. 2 is an external perspective view showing the nonreciprocal circuit device shown in FIG. 1 in an assembled state.

FIG. 1 is an exploded perspective view showing the configuration of a nonreciprocal circuit device according to a first embodiment of the present invention, and FIG. 2 is an external perspective view showing the nonreciprocal circuit device in an assembled state. In the first embodiment, the nonreciprocal circuit device is a lumped-constant isolator 1.

Referring to FIG. 1, the lumped-constant isolator 1 generally comprises a lower casing 4, an upper casing 8, a resin casing 3, a center electrode assembly 13, a permanent magnet 9, a resistive element R, matching capacitors C1, C2 and C3, a resin member 10, and other components which are known to those skilled in the pertinent art.

The lower casing 4 has right and left side walls 4*a* and a bottom wall 4*b*. The upper casing 8 is rectangular in plan, and has an upper wall 8*a* and four side walls 8*b*. The lower casing 4 and the upper casing 8 are made of a material chiefly containing iron, and are formed by, for example, pressing a rolled-steel thin plate chiefly containing iron. The thin plate is finished by using an appropriate working roll so that the average value of surface roughness Ra is less than or equal to 0.9 $\mu$m. Since the surface roughness Ra varies over the surface of the thin plate under the above finishing condition, the maximum value of the surface roughness Ra of the thin plate is set to be less than or equal to 5 $\mu$m in the first embodiment. The lower casing 4 and the upper casing 8 are produced by plating the front and rear surfaces of the thin plate with Cu or Ag and stamping and bending the plated plate.

The resin casing 3 has a bottom portion 3*a* and four side portions 3*b*. A circular window 3*c* is formed in the center of the bottom portion 3*a*. An input terminal 14, an output terminal 15, and two ground terminals 16 are insert-molded in the resin casing 3. One end of the input terminal 14 is exposed at the outer side face of the resin casing 3, and the other end thereof is exposed from the inner side face of the resin casing 3 so as to form an input lead electrode 14*a*. One end of the output terminal 15 is exposed at the outer side face of the resin casing 3, and the other end thereof is exposed from the inner side face of the resin casing 3 so as to form an input-output lead electrode (not shown). Similarly, the ground terminals 16 are exposed at the outer side faces of the resin casing 3 at one end, and are exposed from the opposing inner side faces of the resin casing 3 at the other end so as to form ground lead electrodes 16*a*. Preferably, the resin casing 3 is made of, for example, a liquid crystal polymer, PPS (polyphenylene sulfide), or plastic. The liquid crystal polymer and PPS have high heat resistance and a low loss factor.

In the center electrode assembly 13, three center electrodes 21, 22, and 23 are placed on the upper surface of a circular microwave ferrite 20 with an insulating sheet (not shown) so that they cross one another at approximately 120°. Ports P1, P2 and P3 disposed at first ends of the center electrodes 21, 22 and 23 are horizontally led out, and a common ground electrode 25 disposed at the other ends thereof is in contact with the lower surface of the ferrite 20. The common ground electrode 25 covers most of the lower surface of the ferrite 20, and is connected to the bottom wall 4*b* of the lower casing 4 through the window 3*c* of the resin casing 3, which will be described later, by soldering or by other means, thus being grounded. The center electrodes 21 to 23 and the ground electrode 25 are made of a conductive material, such as Ag, Cu, Au, Al, or Be, and are integrally formed by stamping or etching a thin plate of the conductive material.

Hot capacitor electrodes of the matching capacitors C1, C2 and C3 are soldered to the ports P1, P2 and P3, and cold capacitor electrodes thereof are soldered to the ground lead electrodes 16*a* of the ground terminals 16 exposed from the inner side faces of the resin casing 3.

Figure 3:
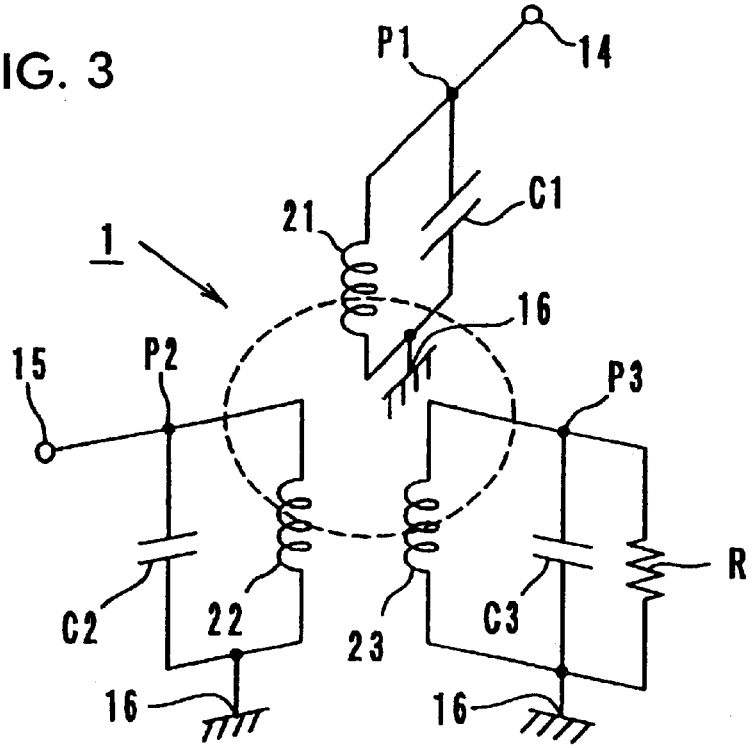
FIG. 3 is an electrically equivalent circuit diagram of the nonreciprocal circuit device shown in FIG. 2.

In the resistive element R, a ground terminal electrode and a hot terminal electrode are formed at both ends of an insulating substrate by thick-film printing or by other means, and a resistor formed of a thick film of cermet, carbon, or ruthenium or a metal thin film is placed therebetween. The insulating substrate is made of, for example, a dielectric ceramic such as alumina. The surface of the resistor may be coated with glass. The ground electrode terminal is soldered to the ground lead electrode 16*a* of the ground terminal 16, and the hot terminal electrode is soldered to the port P3 on the upper surface of the resistive element R. That is, as shown in FIG. 3, the matching capacitor C3 and the resistor R are electrically connected in parallel between the port P3 of the center electrode 23 and the ground terminal 16.

For soldering, Sn—Sb, Sn—Pb, and Sn—Ag solders may be used. Above all, a Sn—Sb solder which is free from lead and has a high melting point is preferable from the viewpoint of environmental pollution prevention and efficiency of reflow soldering of the isolator 1.

As shown in FIG. 1, the resin member 10 is placed on the resistive element R and the matching capacitors C1, C2 and C3. In order to reduce the thickness of the isolator 1, a hole 10*a* is formed at about the center of the resin member 10 so as to accommodate the center electrodes 21 to 23 stacked at the center of the upper surface of the center electrode assembly 13, and the insulating sheet. The hole 10*a* is not always necessary. Preferably, the resin member 10 is made of a liquid crystal polymer or PPS (polyphenylene sulfide) because these materials have high heat resistance and a low loss factor.

The resin casing 3, the center electrode assembly 13, the matching capacitors C1, C2 and C3, the resistive element R, and the like are put in the lower casing 4, the resin member 10 and the permanent magnet 9 are stacked thereon, and the upper casing 8 is mounted thereon. The permanent magnet 9 applies a DC magnetic field to the center electrode assembly 13. The lower casing 4 and the upper casing 8 are joined to constitute a metal casing, to form a magnetic circuit, and to also function as a yoke. this way, the lumped-constant isolator 1 shown in FIG. 2 is produced. The lumped-constant isolator 1 has a length of 7.0 mm, a width of 7.0 mm, and a thickness of 2.0 mm. FIG. 3 is an electrically equivalent circuit diagram of the lumped-constant isolator 1.

In the above-described isolator 1, the average value of the surface roughness Ra of the lower casing 4 and the upper casing 8 is set less than or equal to 0.9 $\mu$m. Therefore, the loss of high-frequency current passing through the lower casing 4 and the upper casing 8 is reduced, and the insertion loss of the isolator 1 can be reduced. As a result, it is possible to achieve the isolator 1 with high reliability and high performance.

Figure 4:
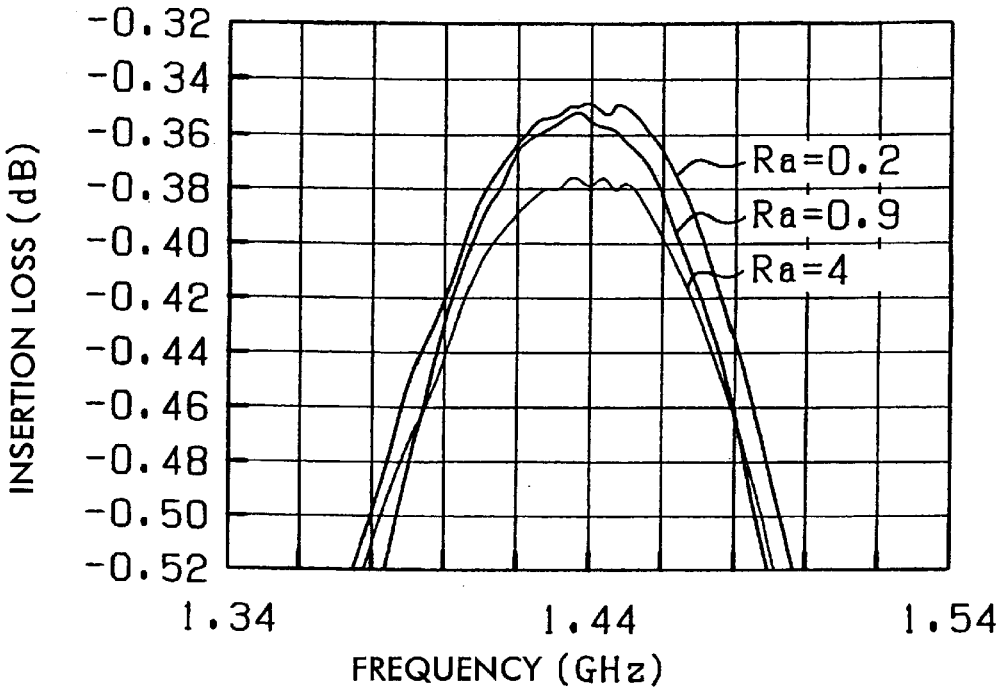
FIG. 4 is a graph showing the insertion loss characteristic with respect to the frequency in the nonreciprocal circuit device.

FIG. 4 is a graph showing the insertion loss characteristics of the isolator 1 in cases in which the average value of the surface roughness Ra of the lower casing 4 and the upper casing 8 is 0.2 $\mu$m and 0.9 $\mu$m. For comparison, FIG. 4 also shows the insertion loss characteristic of the isolator 1 in a case in which the average value of the surface roughness Ra is 4 $\mu$m. As shown in FIG. 4, there is no great difference in insertion loss between the cases in which the average value of the surface roughness Ra is 0.2 $\mu$m and 0.9 $\mu$m and that the insertion loss is satisfactorily reduced.

Figure 5:
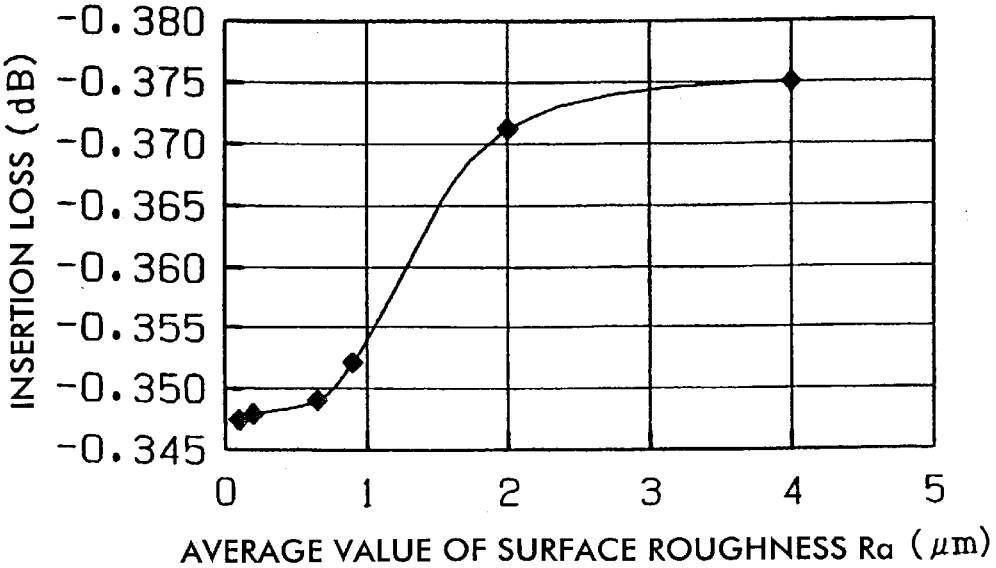
FIG. 5 is a graph showing the insertion loss characteristic with respect to the average value of the surface roughness Ra in the nonreciprocal circuit device.

FIG. 5 is a graph showing the relationship between the average value of the surface roughness Ra of the lower casing 4 and the upper casing 8 and the insertion loss characteristic of the isolator 1. As shown in FIG. 5, the insertion loss does not greatly vary when the average value of the surface roughness Ra is less than or equal to 0.9 $\mu$m, and the insertion loss is satisfactorily reduced. Conversely, the insertion loss rapidly increases when the average value of the surface roughness Ra exceeds 0.9 $\mu$m.

A portable telephone will now be described as an example of a communication device according to a second embodiment of the present invention.

Figure 6:
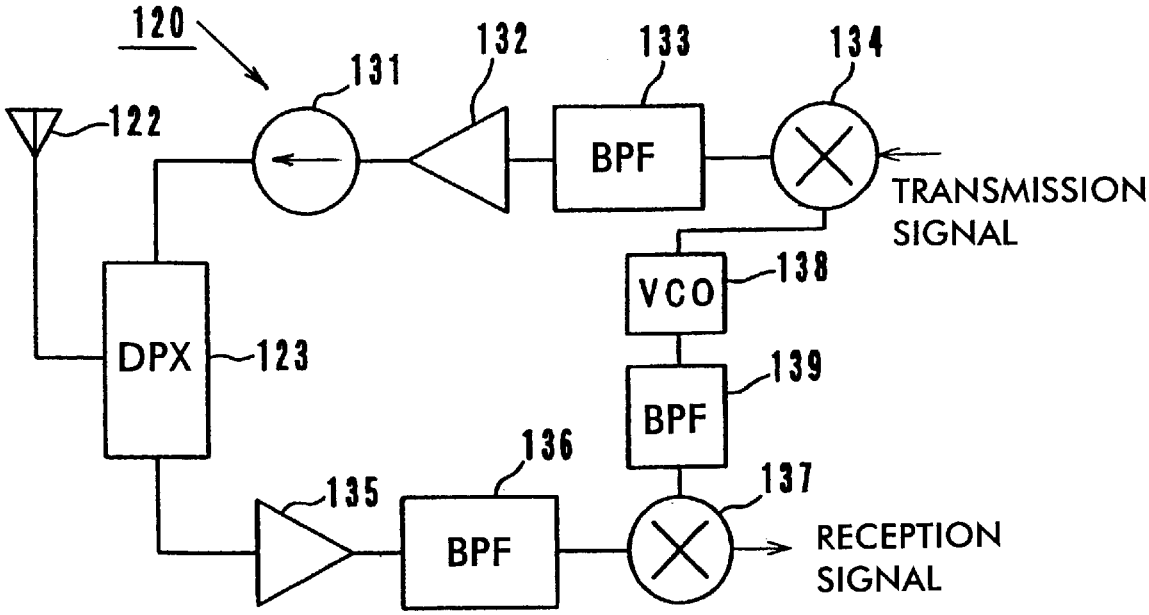
FIG. 6 is a block diagram of a communication device according to a second embodiment of the present invention.

FIG. 6 is an electrical circuit diagram of a RF section of a portable telephone 120. Referring to FIG. 6, the portable telephone 120 comprises an antenna element 122, a duplexer 123, a transmission-side isolator 131, a transmission-side amplifier 132, a transmission-side interstage bandpass filter 133, a transmission-side mixer 134, a reception-side amplifier 135, a reception-side interstage bandpass filter 136, a reception-side mixer 137, a voltage control oscillator (VCO) 138, and a local bandpass filter 139.

The lumped-constant isolator 1 of the first embodiment can be used as the transmission-side isolator 131. By utilizing the isolator 1, a portable telephone having superior electrical characteristics can be achieved.

While the present invention has been described with reference to what is presently considered to be the best mode of practicing the invention, it is to be understood that the invention is not limited to the disclosed embodiments. On the contrary, the invention is intended to cover various modifications and equivalent arrangements included within the spirit and scope of the appended claims.

For example, while the present invention is applied to the isolator in the embodiments, it is also applicable to a circulator and other high-frequency components. The center electrodes may be formed by mounting a pattern electrode on a substrate (for example, a dielectric substrate, a magnetic substrate, or a multilayered substrate) instead of stamping and bending a metal plate. It is satisfactory as long as the crossing angle of the center electrodes is within the range of 110° to 140°. The metal casing may be divided into three or more parts. The shape of the ferrite is not limited to a circle, and other shapes, such as a rectangle or a hexagon, may be adopted.

What is claimed is:

1. A nonreciprocal circuit device comprising:

a permanent magnet;

a ferrite to which a DC magnetic field is applied by said permanent magnet;

a plurality of center electrodes placed on said ferrite; and a metal casing for accommodating said permanent magnet, said ferrite, and said center electrodes, wherein said metal casing is made of a material chiefly containing iron, and the average value of the surface roughness of the entirety of said metal casing is less than or equal to 0.9 $\mu$m.

2. A nonreciprocal circuit device as claimed in claim 1, wherein the maximum value of said surface roughness of the entirety of said metal casing is less than or equal to 5 $\mu$m.

3. A nonreciprocal circuit device as claimed in claim 2, wherein said average value is about 0.2 $\mu$m–0.9 $\mu$m.

4. A nonreciprocal circuit device as claimed in claim 1, wherein said nonreciprocal circuit device has an insertion loss of less than about 0.360 dB.

5. A nonreciprocal circuit device as claimed in claim 4, wherein said insertion loss is less than about 0.355 dB.

6. A nonreciprocal circuit device as claimed in claim 5, wherein said insertion loss is less than about 0.350 dB.

7. A communication device having at least one nonreciprocal circuit device according to claim 1.

8. A nonreciprocal circuit device as claimed in claim 1, wherein said average value is about 0.2 $\mu$m–0.9 $\mu$m.

* * * * *